US011297880B2

(12) United States Patent
Zhang et al.

(10) Patent No.: US 11,297,880 B2
(45) Date of Patent: Apr. 12, 2022

(54) HEATER, CARTRIDGE, ATOMIZER AND ELECTRONIC CIGARETTE HAVING SAME

(71) Applicant: Shenzhen First Union Technology Co., Ltd., Shenzhen (CN)

(72) Inventors: Qing Zhang, Shenzhen (CN); Zhengfa Li, Shenzhen (CN); Yunkai Zhang, Shenzhen (CN); Baoling Lei, Shenzhen (CN); Desheng Huang, Shenzhen (CN); Zhongli Xu, Shenzhen (CN); Yonghai Li, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 278 days.

(21) Appl. No.: 16/542,359

(22) Filed: Aug. 16, 2019

(65) Prior Publication Data

US 2020/0054075 A1 Feb. 20, 2020

(30) Foreign Application Priority Data

Aug. 17, 2018 (CN) ..... 201810940788.2

(51) Int. Cl.

| | |
|---|---|
| ***A24F 40/46*** | (2020.01) |
| ***H05B 3/44*** | (2006.01) |
| ***A24F 40/44*** | (2020.01) |
| ***A24F 40/10*** | (2020.01) |

(52) U.S. Cl.

CPC ..... *A24F 40/46* (2020.01); *A24F 40/44* (2020.01); *H05B 3/44* (2013.01); *A24F 40/10* (2020.01); *H05B 2203/021* (2013.01)

(58) Field of Classification Search

CPC ..... A24F 40/16; A24F 40/44; H05B 3/44

See application file for complete search history.

(56) References Cited

U.S. PATENT DOCUMENTS

| | | | | |
|---|---|---|---|---|
| 9,888,727 | B2 * | 2/2018 | Li | A24F 40/44 |
| 2008/0092912 | A1 * | 4/2008 | Robinson | A24D 1/20 131/200 |
| 2017/0105454 | A1 * | 4/2017 | Li | A24F 40/46 |
| 2018/0289058 | A1 * | 10/2018 | Chen | A24F 40/70 |
| 2018/0317558 | A1 * | 11/2018 | Qiu | A61M 15/06 |
| 2018/0360112 | A1 * | 12/2018 | Qiu | H05B 3/42 |

(Continued)

FOREIGN PATENT DOCUMENTS

| | | |
|---|---|---|
| CN | 204 599 335 U | 9/2015 |
| CN | 105 310 114 A | 2/2016 |
| EP | 2 888 963 A1 | 7/2015 |

*Primary Examiner* — Jean F Duverne

(74) *Attorney, Agent, or Firm* — Proi Intellectual Property US

(57) ABSTRACT

A heater, a cartridge, an atomizer and an electronic cigarette having same are disclosed, the heater includes a porous body, configured for absorbing tobacco liquid; the porous body having an absorbing surface and an atomizing surface opposite with each other; the tobacco liquid permeating from the absorbing surface to the atomizing surface; a heating element, disposed on the atomizing surface and configured to atomize the tobacco liquid stored in the porous body into an aerosol; and part of the porous body that is near the atomizing surface having a less thermal conductivity than part of the porous body that is near the absorbing surface, resulting in a big amount of aerosol while not easy to generate burnt flavor and improving user experience.

17 Claims, 3 Drawing Sheets

(56) References Cited

U.S. PATENT DOCUMENTS

| | | | | |
|---|---|---|---|---|
| 2019/0037926 | A1* | 2/2019 | Qiu | A24F 40/485 |
| 2019/0223504 | A1* | 7/2019 | Chen | A24F 40/42 |
| 2019/0335814 | A1* | 11/2019 | Qiu | A61M 15/06 |
| 2019/0373949 | A1* | 12/2019 | Pan | A24F 40/44 |

* cited by examiner

HEATER, CARTRIDGE, ATOMIZER AND ELECTRONIC CIGARETTE HAVING SAME

TECHNICAL FIELD

The present disclosure relates to the field of smoking articles, and particularly to a heater, a cartridge, an atomizer and an electronic cigarette having same.

BACKGROUND ART

An electronic cigarette is a kind of electronic product mimicking traditional cigarettes, with a same appearance, aerosol smog, taste and feelings. By replying on application of atomization to tobacco liquid, the tobacco liquid containing nicotine is transformed into an aerosol drawn by the user. Since the electronic cigarette is portable without open flames, and environmental friendly, the heater is widely applied to our daily life.

The electronic cigarette typically includes a heater for heating the tobacco liquid to generate an aerosol upon the heater is powered, the current heater generally includes a porous body in a tube shape and a heater secured inside the porous body, an inner surface of the porous body works as an atomizing surface; an outer surface thereof works as an absorbing surface for absorbing the tobacco liquid. In prior art, part of the porous body near to the atomizing surface has a same thermal conductivity as part of the porous body near to the absorbing surface.

However, in terms of the atomizing surface of the porous body, it needs low thermal conductivity such that the heat generated by the heating element focus on inside of the porous body to aerosolize the tobacco liquid into an aerosol. However, it has to prevent the temperature of the absorbing surface from getting too high. Otherwise the heat generated by the heating element won't diffuse out successively thus the temperature of the absorbing surface is increasingly going up, which is easy to cause dry burn of the heating element and generate burnt flavor, therefore the user's taste and using experience is damaged.

Therefore, the porous body with a single thermal conductivity is difficult to generate a large amount of aerosol without producing burnt flavor.

SUMMARY

To resolve the above problem that the porous body with a single thermal conductivity is difficult to generate a large amount of aerosol without producing burnt flavor, the present disclosure generally relates to a porous body generating a large amount of aerosol without burnt flavor, and a heater, a cartridge, an atomizer and electronic cigarette having the same.

In the first aspect, the present disclosure relates to a heating element including:

a porous body, configured for absorbing tobacco liquid; the porous body having an absorbing surface and an atomizing surface opposite with each other; the tobacco liquid permeating from the absorbing surface to the atomizing surface;

a heating element, disposed on the atomizing surface and configured to atomize the tobacco liquid stored in the porous body into an aerosol;

part of the porous body that is near the atomizing surface includes a less thermal conductivity than part of the porous body that is near the absorbing surface.

Optionally, the porous body has a first layer that is near the atomizing surface and a second layer that is near the absorbing layer; the thermal conductivity of the first layer is less than that of the second layer.

Optionally, a material of the first layer includes at least one or more of silicon oxides, silicon nitrides, diatomite and silicates.

A material of the second layer includes at least one or more of aluminum oxides, silicon carbides, aluminum nitrides, beryllium oxides and boron nitrides.

Optionally, a porosity of the first layer is equal to that of the second layer.

Optionally, a thickness of the first layer is less than that of the second layer.

Optionally, the heating element is integrated with the first layer and the second layer.

Optionally, part of the porous body that is near the atomizing surface has a greater porosity than part of the porous body that is near the absorbing surface.

Optionally, the porous body from near and far from the atomizing surface has a decreasing porosity.

In a second aspect, the present disclosure provides a cartridge including:

a supporter;

a heater, received in the supporter, the heater is in accordance with the aforementioned heater.

In a third aspect, the present disclosure provides an atomizer including:

a shell, with a liquid storage chamber formed therein;

an cartridge, received in the shell, the cartridge is in accordance with the aforementioned cartridge.

In a fourth aspect, the present disclosure provides an electronic cigarette including:

an atomizer and a power supply configured for supplying power to the atomizer, when the atomizer is powered, it heats tobacco liquid stored in the atomizer to generate an aerosol; and the atomizer is in accordance with the aforementioned atomizer.

Compared with the prior art porous body with a single porosity, part of the porous body that is near the atomizing surface has a less thermal conductivity than part of the porous body that is near the absorbing surface, which is easy to generate burnt flavor while ensures a large amount of aerosol, improving the user experience.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

Figure 1:
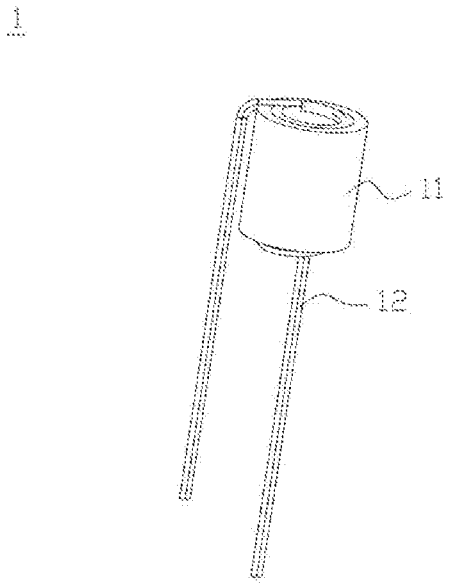
FIG. 1 is an aspect view of a heater according to a first embodiment of the present disclosure.

Numerals indicating components are illustrated herein:

| | | | |
|---|---|---|---|
| Heater 1 | Porous body 11 | First layer 111 | Second layer 112 |
| Atomizing surface 113 | Absorbing surface 114 | Heating element 12 | Cartridge 2 |
| Supporter 21 | Liquid conductive hole 210 | Absorbing cotton 22 | Atomizer 3 |
| Shell 31 | Reservoir 310 | Mouth piece 32 | Electronic cigarette 4 |
| Power supply set 41 | | | |

DETAILED DESCRIPTION

Provided herein are an electronically-operated aerosol-generating article (alternatively referred to as vaporization devices or electronic vaping devices etc.) generally heats a liquid aerosolizable material (i.e. tobacco liquid) containing nicotine to generate an aerosol, eventually drawn by the users.

Figure 2:
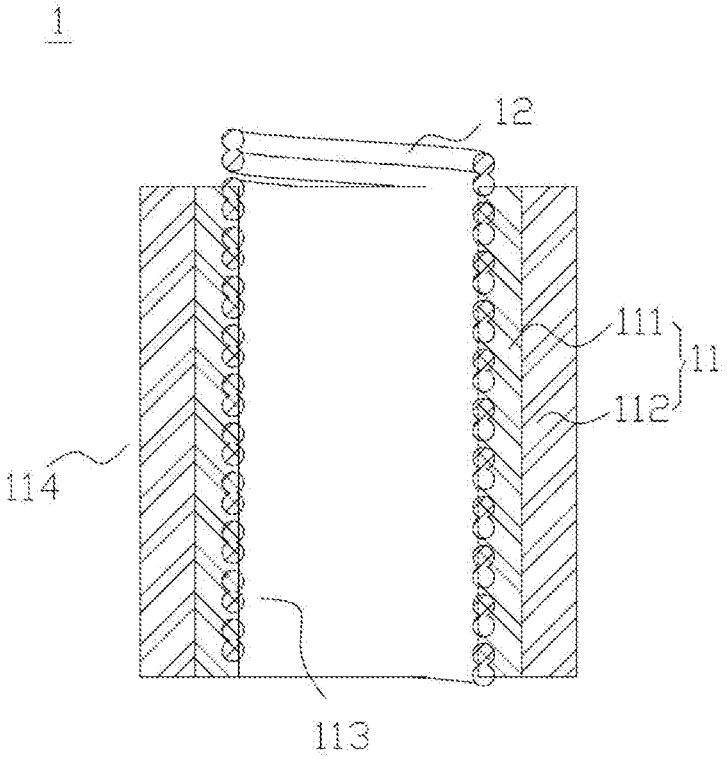
FIG. 2 is a cross-sectional view of the heater according to the first embodiment of the present disclosure.

Referring to FIG. 1 and FIG. 2, the present disclosure relates to a heater 1, the heater 1 includes a porous body 11 and a heating element 12.

The material of the porous body 11 includes porous ceramic materials, the porous body 11 is a hollow tube, including an inner first layer 111 and an outer second layer 112, the first layer 111 has a less thermal conductivity than the second layer 112, the first layer 111 has a same porosity as the second layer 112, and the first layer 111 has a less thickness than the second layer 112.

In the embodiment, a thermal conductivity of the first layer 111 is 0-5 W/(m*K), the thermal conductivity of the second layer 112 is 5-35 W/(m*K), a thickness of the first layer 111 is 0-0.8 mm and the thickness of the second layer 112 is 0.8-5 mm.

The material of the first layer 111 includes ceramic materials with a low thermal conductivity made of silicon oxide, silicon nitride, diatomite, silicates and so on. The material of the second layer 112 includes ceramic materials with a high thermal conductivity made of aluminum oxide, silicon carbide, aluminum nitride, beryllium oxide, boron nitride and so on. The first layer 111 and the second layer 112 may be lap formed, integrated or injection-molded either.

The porous body 11 typically works as a liquid conductive element to absorb tobacco liquid from the reservoir 310, then the outer second layer 112 conveys the tobacco liquid to the inner first layer 111.

Understandable, in some embodiments, the porous body 11 includes rigid capillary structures such as cellular glass ceramics, porous glass and so on.

The heating element 12 is received in the porous body 11. The heating element 12 is integrated with the porous body 11, that is the porous body 12 and the first layer 111 are integrated. When the heating element 12 is powered, it heats the tobacco liquid stored in the porous body 11 to generate an aerosol. The aerosol is expelled out through a central air flow path of the porous body 11. The porous body 11 has a surface near the heating element 12 working as an atomizing surface 113, the porous body 11 has an opposite surface far from the heating element 12 working as an absorbing surface 114. The thermal conductivity of the atomizing surface 113 is less than that of the absorbing surface 114, that is an inner surface of the porous body 11 is less than that an outer surface of the porous body 11.

In the embodiment, the heating element 12 includes an electrically resistance wire, understandable, in some other embodiments, the heating element 12 includes an electrically resistance strip, an electrically resistance tube or some other structures.

Understandable, in some other embodiments, the porous body 11 is also made by porous ceramic materials. Part of the porous body 11 that is near the atomizing surface 113 has a greater porosity than part of the porous body 11 that is away from the atomizing surface 113, thus part of the porous body 11 that is near the atomizing surface 113 has a less porosity than part of the porous body 11 that is away from the atomizing surface 113.

Understandable, in some other embodiments, the porous body 11 from near and far from the atomizing surface 113 has a decreasing porosity.

Figure 3:
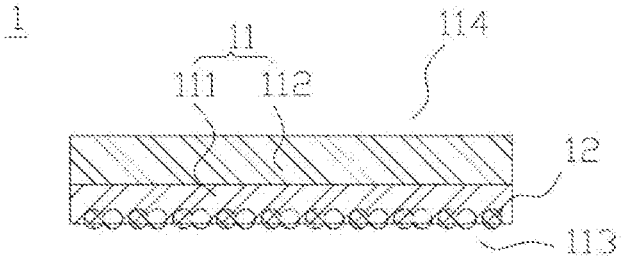
FIG. 3 is a cross-sectional view of the heater according to other embodiments of the present disclosure.

Understandable, in FIG. 3, the porous body 11 may be made in other shapes, such as, the porous body 11 is plate-shaped, in this case, the heating element 12 is the heating strip accordingly, only ensuring the porosity of the porous body 11 from near and far from the atomizing surface 113 is decreasing.

Understandable, the porous body 11 may be shaped and determined in accordance with specific shapes of the cartridge 2, such as an arch, a W-shape, a H-shape, and another shapes.

In the embodiment, the second layer 112 absorbs tobacco liquid from the reservoir 310 (not shown), the tobacco liquid flows into the inner first layer 111 through the second layer 112. When the heating element 12 is powered, it heats the tobacco liquid absorbed from the porous body 11 to generate an aerosol expelled through the air flow path at the central of the porous body.

Compared with the prior art porous body 11 with a single thermal conductivity, the porous body 11 from near and far from the atomizing surface has an increasing thermal conductivity to ensure the heat generated by the heating element 12 is concentrated inside the porous body 11 for aerosol generation, which realizes the electronic cigarettes 4 containing the above heater 1 to generate a large amount of aerosol. Meanwhile, since part of the porous body 11 that is far from the atomizing surface 113 has a comparatively high thermal conductivity, excess heat generated by the heating wire would be effectively diffused out without generating burnt flavor, improving user experience.

Embodiment Two

Figure 4:
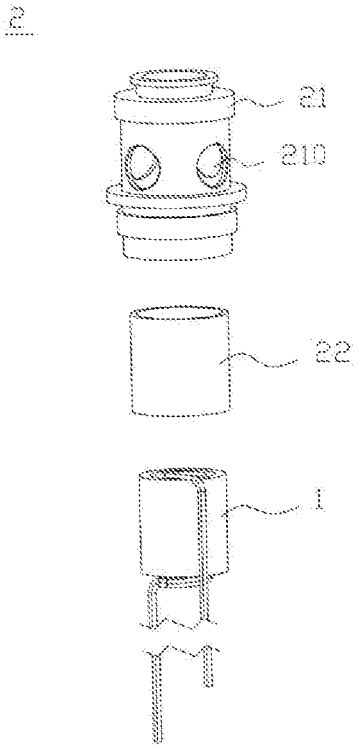
FIG. 4 is an exploded view of a cartridge according to a second embodiment of the present disclosure.

Referring to FIG. 4, the present disclosure relates to a cartridge 2 in accordance with a second embodiment. The cartridge 2 includes a supporter 21, an absorbing cotton 22 and a heater 1, of which, the heater 1 is the same as the heater in embodiment one without further description thereto.

The supporter 21 is a hollow tube, a sidewall of the supporter 21 has a liquid conductive hole 210 that is in communication with the liquid storage chamber 310 (not shown).

The liquid absorbing cotton 22 is wrapped around the heater 1, that is wrapped around the porous body 11, and received in the supporter 21 with the heater 1 together. The liquid absorbing cotton 22 is configured for absorbing tobacco liquid from the reservoir 310 and conveying the tobacco liquid to the porous body 11, in this case, the liquid absorbing cotton 22 also has a function of locking the tobacco liquid to prevent the tobacco liquid stored in the liquid absorbing cotton 22 form leaking out of the cartridge 2.

Embodiment Three

Figure 5:
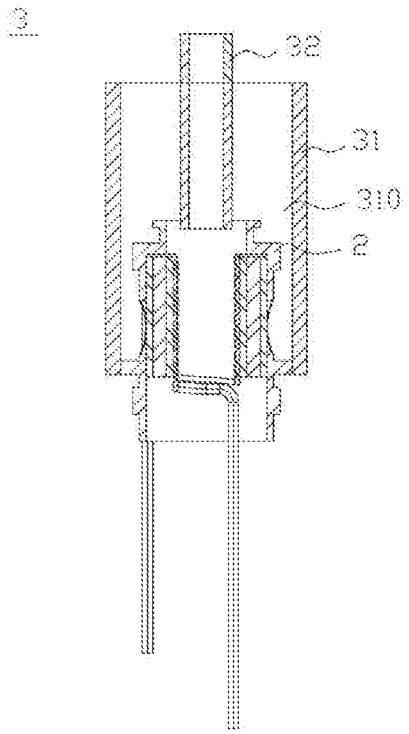
FIG. 5 is a cross-sectional view of an atomizer according to a third embodiment of the present disclosure.

Referring to FIG. 5, an atomizer 3 is disclosed in the present disclosure. The atomizer 3 includes a shell 31, a cartridge 2 and a mouthpiece 32. As used herein, the cartridge 2 is in accordance with the cartridge in the second embodiment without further description thereto.

The shell 31 is a hollow tube, received and secured at one end of the shell 31, the mouthpiece 32 is secured at an opposite end of the shell 31. The shell 31 has a reservoir 310 formed therein, configured for storing tobacco liquid. That is, the mouthpiece 32, the shell 31 and the cartridge 2 encompass the reservoir 310.

Embodiment Four

Figure 6:
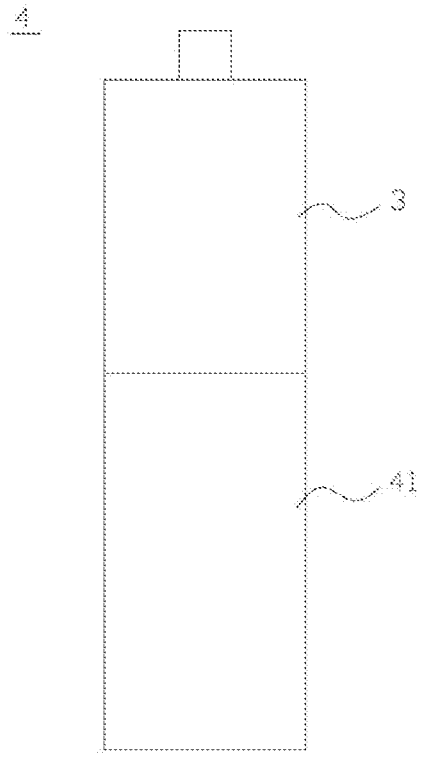
FIG. 6 is an aspect view of an electronic cigarette according to a fourth embodiment of the present disclosure.

Referring to FIG. 6, an electronic cigarette 4 is disclosed in the present disclosure. The electronic cigarette 4 includes an atomizer 3 and a power supply set 41. As used herein, the atomizer 3 is the same as the atomizer in accordance with embodiment three.

The power supply set 41 is configured for supplying power to the atomizer 3, to allow the heating element 12 in the atomizer 3 to heat and atomize the tobacco liquid stored in the porous body 11 when the heating element 12 is powered, so as to generate an aerosol drawn by the user directly.

Understandable, the power supply set 41 includes a battery that includes a dry battery, a lithium battery or a rechargeable battery.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A heater applied to an electronic cigarette, comprising:

a porous body, configured for absorbing tobacco liquid; the porous body having an absorbing surface and an atomizing surface opposite with each other; the tobacco liquid permeating from the absorbing surface to the atomizing surface;

a heating element, disposed on the atomizing surface and configured to atomize the tobacco liquid stored in the porous body into an aerosol; and part of the porous body that is near the atomizing surface comprising a less thermal conductivity than part of the porous body that is near the absorbing surface.

2. The heater according to claim 1, wherein the porous body comprises a first layer that is near the atomizing surface and a second layer that is near the absorbing layer; the thermal conductivity of the first layer is less than that of the second layer.

3. The heater according to claim 2, wherein a material of the first layer comprises at least one of silicon oxides, silicon nitrides, diatomite and silicates;

a material of the second layer comprises at least one of aluminum oxides, silicon carbides, aluminum nitrides, beryllium oxides and boron nitrides.

4. The heater according to claim 2, wherein a porosity of the first layer is equal to that of the second layer.

5. The heater according to claim 2, wherein a thickness of the first layer is less than that of the second layer.

6. The heater according to claim 2, wherein the heating element is integrated with the first layer and the second layer.

7. The heater according to claim 1, wherein part of the porous body that is near the atomizing surface has a greater porosity than part of the porous body that is near the absorbing surface.

8. The heater according to claim 1, wherein the porous body from near and far from the atomizing surface has a decreasing porosity.

9. An atomizer applied to an electronic cigarette, comprising:

a shell, with a reservoir formed therein and configured for storing tobacco liquid; and a cartridge received in the shell, comprising:

a supporter; and a heater received in the supporter, comprising:

a porous body, configured for absorbing tobacco liquid; the porous body having an absorbing surface and an atomizing surface opposite with each other; the tobacco liquid permeating from the absorbing surface to the atomizing surface;

a heating element, disposed on the atomizing surface and configured to atomize the tobacco liquid stored in the porous body into an aerosol; and part of the porous body that is near the atomizing surface comprising a less thermal conductivity than part of the porous body that is near the absorbing surface.

10. The atomizer according to claim 9, wherein the porous body comprises a first layer that is near the atomizing surface and a second layer that is near the absorbing layer; the thermal conductivity of the first layer is less than that of the second layer.

11. The atomizer according to claim 10, wherein a material of the first layer comprises at least one of silicon oxides, silicon nitrides, diatomite and silicates;

a material of the second layer comprises at least one of aluminum oxides, silicon carbides, aluminum nitrides, beryllium oxides and boron nitrides.

12. The atomizer according to claim 10, wherein a porosity of the first layer is equal to that of the second layer.

13. The atomizer according to claim 10, wherein a thickness of the first layer is less than that of the second layer.

14. The atomizer according to claim 10, wherein the heating element is integrated with the first layer and the second layer.

15. The atomizer according to claim 9, wherein part of the porous body that is near the atomizing surface has a greater porosity than part of the porous body that is near the absorbing surface.

16. The atomizer according to claim 9, wherein the porous body from near and far from the atomizing surface has a decreasing porosity.

17. An electronic cigarette, comprising:

an atomizer; and a power supply set, configured for supplying power to the atomizer;

wherein when the atomizer is powered the atomizer heats tobacco liquid to generate an aerosol, and the atomizer is in accordance with claim 9.

* * * * *